US012004669B2

(12) United States Patent
Zogno

(10) Patent No.: US 12,004,669 B2
(45) Date of Patent: Jun. 11, 2024

(54) SHOE COVER DISPENSER

(71) Applicant: V.Z. GROUP SAGL, Lugano (CH)

(72) Inventor: Davide Zogno, Tribano (IT)

(73) Assignee: V.Z. Group SAGL, Lugano (CH)

( * ) Notice: Subject to any disclaimer, the term of this patent is extended or adjusted under 35 U.S.C. 154(b) by 0 days.

(21) Appl. No.: 17/909,997

(22) PCT Filed: Mar. 26, 2020

(86) PCT No.: PCT/IB2020/052854
§ 371 (c)(1),
(2) Date: Sep. 8, 2022

(87) PCT Pub. No.: WO2021/181142
PCT Pub. Date: Sep. 16, 2021

(65) Prior Publication Data

US 2023/0355017 A1 Nov. 9, 2023

(30) Foreign Application Priority Data

Mar. 9, 2020 (IT) ..... 102020000004945

(51) Int. Cl.
*A47G 25/90* (2006.01)
*A43B 7/00* (2006.01)
*B65D 83/08* (2006.01)

(52) U.S. Cl.
CPC ..... *A47G 25/90* (2013.01); *A43B 7/00* (2013.01); *B65D 83/0894* (2013.01)

(58) Field of Classification Search
CPC .... A47G 25/90; A47G 25/905; A47G 25/907; A47G 25/92; A47G 25/80; A47G 25/84; A43B 7/00; A43B 3/16; A43B 3/163; A43B 3/166; A43B 3/18; B65D 83/0894; B65D 83/08; B65D 83/0876
USPC ..... D6/515, 517
See application file for complete search history.

(56) References Cited

U.S. PATENT DOCUMENTS 28,927 A * 6/1860 Wheeler ..... A47G 25/80 223/114
3,775,793 A * 12/1973 Casavant ..... A43D 11/003 12/1 R
4,387,515 A * 6/1983 Baldwin ..... A43B 5/18 36/130
4,928,849 A * 5/1990 Khozai ..... A47F 1/08 221/48
7,108,154 B1 * 9/2006 Thompson ..... A43B 3/163 221/56
D529,263 S * 10/2006 Wolf ..... D2/923
(Continued)

*Primary Examiner* — Ismael Izaguirre
(74) *Attorney, Agent, or Firm* — John A. Fortkort; Fortkort & Houston PC

(57) ABSTRACT

The invention is a shoe cover dispenser (10) comprising a container (1) with two opposite containment sides (11, 12) and an opening for the insertion of a foot, and a plurality of shoe covers (2, 3) contained in said container (1), each shoe cover (2, 3) in turn comprising a covering provided with an opening (21, 31) for the insertion of a foot. Each shoe cover (2, 3) comprises a flexible strip (A, B) constrained along a part of the edge (22, 32) of said opening (21, 31) of the covering, and wherein the ends (A1, A2, B1, B2) of said strip (A, B) are respectively constrained to said opposite sides (11, 12), so that said strip is forcedly held between said sides (11, 12) while assuming the form of a U.

8 Claims, 3 Drawing Sheets

(56) References Cited

U.S. PATENT DOCUMENTS

| | | | | |
|---|---|---|---|---|
| 7,669,351 | B1 * | 3/2010 | Ghotbi | A43B 3/163 36/7.1 R |
| 8,533,868 | B2 * | 9/2013 | Bhalla | A41D 19/015 2/160 |
| 8,657,151 | B2 * | 2/2014 | Balkin | A47K 10/32 223/111 |
| 2002/0020031 | A1 * | 2/2002 | Gultekin | A47G 25/80 12/142 R |
| 2009/0152312 | A1 * | 6/2009 | Li | A47G 25/80 223/111 |
| 2017/0020225 | A1 * | 1/2017 | Hill | A43B 3/18 |

* cited by examiner

SHOE COVER DISPENSER

CROSS-REFERENCE TO RELATED APPLICATION

The present application is a national stage filing of PCT/IB2020/52854, filed on Mar. 26, 2020, which has the same title and the same inventors, and which is incorporated herein by reference in its entirety; which claims priority to IT202000004945, filed Mar. 9, 2020, having the same title, and having the same inventors, and which is incorporated herein by reference in its entirety.

FIELD OF THE DISCLOSURE

The present patent concerns shoe cover dispensers, and more specifically it concerns a new shoe cover dispenser, the use of which is improved and facilitated.

BACKGROUND OF THE DISCLOSURE

Disposable shoe covers are known, which are made with a plastic sheet shaped in such a way as to form a sort of covering or bag provided with an opening for the insertion of a foot wearing a shoe.

The edge of the shoe cover opening is provided with an elastic strip that serves to hold the covering so that it is correctly positioned on the foot and wraps the sole and part of the footwear item.

Shoe covers are generally used in places and environments where specific hygiene and health conditions are required, in order to prevent shoe soles, which are known to be dirty, from coming into direct contact with the floor.

For example, the use of shoe covers is widespread in hospitals, clinics, medical practices, gyms, changing rooms of sports centers, but also in the premises of pharmaceutical industries, agricultural and food industries etc.

Said shoe covers are generally distributed in proximity to the entrance of these places, for example they are held in containers from which the user must extract the shoe cover manually and apply it to his/her shoes.

This operation, even though it seems to be simple and quick, poses several difficulties if the user has to perform it without sitting down, or if the user has limited mobility or his/her movements are limited because he/she is carrying bags, a coat or other personal items.

Automatic shoe cover dispensers are also known.

For example, very sophisticated devices are known, which are electrically powered and are provided with devices suited to automatically apply and adapt a film around the user's shoe. These devices are very expensive and bulky, they cannot be moved, are easily damaged and furthermore require regular maintenance, more specifically the necessary periodic loading of the film used to cover the shoes.

Automatic dispensers that do not require any power supply are also known, which comprise a container filled with a plurality of packed shoe covers that are constrained inside the container with elastic means, so that the user can introduce his/her foot in the container and automatically put on the shoe cover.

These containers need to be filled when they run out of shoe covers and the filling operation is generally rather complex, as it is necessary to arrange the shoe cover pack correctly and to position the elastic means in a specific and convenient manner, strictly following the assembly instructions, otherwise the mechanisms do not work correctly and the shoe covers get stuck.

SUMMARY OF THE DISCLOSURE

Figure 1:
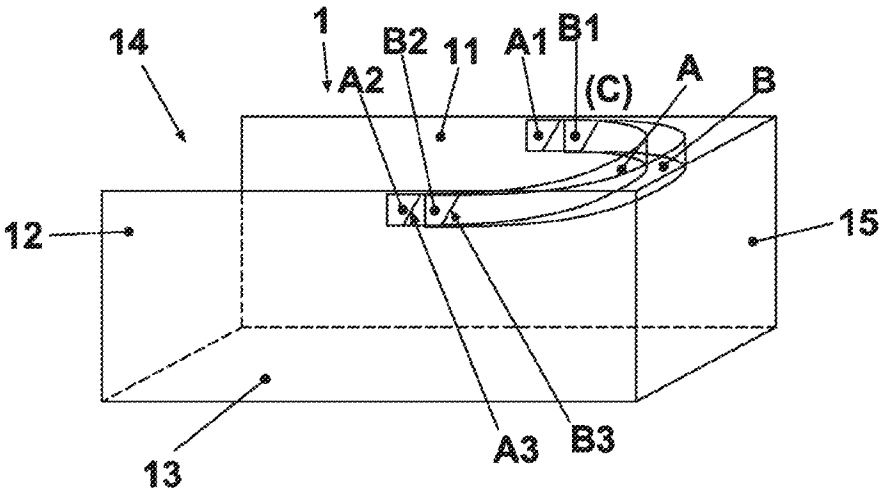
FIG. 1 is a schematic illustration of a container in which two strips (A, B) are positioned near each other, both in the closed configuration (C) and both constrained with their respective ends to two opposite sides (11, 12) of said container (1).

In order to overcome all the drawbacks mentioned above, a new shoe cover dispenser with improved and facilitated use has been designed and constructed.

It is the main object of the present invention to provide a shoe cover dispenser that is easy to use and does not need complicated and demanding operations for filling the dispenser and positioning the shoe covers inside it.

It is another important object of the present invention to provide a shoe cover dispenser whose cost is extremely limited.

It is another object of the present invention to provide a shoe cover dispenser that is not bulky and is light, easy to transport and suited to be positioned anywhere.

These and other direct and complementary objects are achieved by the new shoe cover dispenser with improved and facilitated use, whose main parts comprise the following: a container having at least two sides facing each other and at least one opening for the insertion of a foot wearing a footwear item; a plurality of shoe covers contained in said container; and wherein each shoe cover comprises a bag-shaped covering with an opening for the insertion of a foot wearing a footwear item, and wherein along or in proximity to part of the edge of said opening there is a flexible strip with size exceeding the distance between said two opposite sides of the container, and wherein the two ends of said strip are respectively constrained to said two opposite sides of the container, so that the strip is forcedly held between said sides while assuming the form of a U.

DETAILED DESCRIPTION

Said strip is flexible and can be deformed and assume one of the following configurations: a first closed configuration, in which it is arranged in the form of a U, with its concave part facing in a direction, and more specifically towards the opening of the covering, which is thus kept closed while the shoe cover is packed, and a second open configuration of extraction, in which it is arranged in the form of a U, with its concave part facing in the opposite direction, so that the opening of the shoe cover is open and allows the foot to be introduced therein.

The change between said first closed configuration and said second extraction configuration thus serves to unfold the shoe cover and open the foot insertion opening.

In order to facilitate the change between said closed configuration and said extraction configuration, the strip comprises two folding lines in proximity to the ends.

In the preferred embodiment, said folding lines are inclined with respect to the direction of development of the strip, wherein the inclination angle is larger than 0° and smaller than 90°, and wherein the strip is constrained to the container in such a way that, in said closed configuration, it is substantially horizontal, meaning parallel to the bottom of the container, while in said extraction configuration it is inclined upwards.

This inclined position facilitates the operation of insertion of the foot and extraction of the shoe cover, since the heel or the rear part of the foot acts on the strip.

When the user moves his/her foot backwards to extract a first shoe cover, the latter is unfolded and thus extends also the foot insertion opening, after which the application of a further force causes the ends of the strip to become detached from the container, thus releasing the shoe cover.

The means for constraining said ends of the strip to the container, therefore, are such that the force required to deform the strip is smaller than the force required to detach the ends.

For this purpose, for example, an adhesive material can be conveniently used.

According to the invention, furthermore, each shoe cover is constrained to the successive shoe cover, and more specifically to the strip of the successive shoe cover, in at least one point, so that the complete unfolding and extraction of a first shoe cover at the same time causes said strip of the successive shoe cover to be pulled, and the latter to be unfolded and then opened.

In further detail, a part of the covering of each shoe cover, said part being preferably positioned opposite the strip of the same shoe cover, is removably constrained to the strip of the successive shoe cover.

When the user moves his/her foot, introduced in the shoe cover, backwards, it causes the shoe cover to unfold completely and at the same time exert a traction force on the strip of the successive shoe cover, causing its configuration to change from the closed configuration to the extraction configuration; at this point the first shoe cover comes off the strip.

The constraining means between two successive shoe covers are thus such that the force applied to deform the strip is smaller than the force required to detach a shoe cover from the strip of the successive shoe cover.

For this purpose, for example, an adhesive material can be conveniently used.

Along the entirety or part of the edge of said opening of each shoe cover there is an elastic element, for example a thread or band, which is intended to guarantee that the shoe cover remains correctly fitted around the user's foot.

The characteristics of the new shoe cover dispenser are highlighted in greater detail in the following description, with reference to the drawings that are attached hereto by way of non-limiting example.

FIG. 1 shows a schematic view of a container (1) in which two strips (A, B) are positioned near each other, both in the closed configuration (C) and both constrained with their respective ends to two opposite sides (11, 12) of said container (1).

Said container (1), in a very simple and economical embodiment, is substantially in the shape of a parallelepiped, for example it is a cardboard box, with two opposite and parallel containment sides (11, 12) and a bottom (13). According to the invention, one of the head sides and the top side, not shown in the drawings, can be absent or preferably removable, or in any way shaped so as to form an opening (14) for the insertion of a foot.

Figure 2:
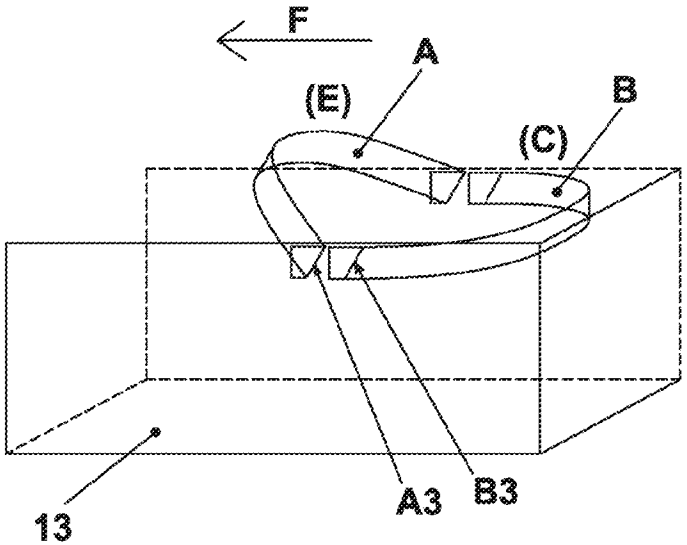
FIG. 2 is a schematic view of the container of FIG. 1, wherein a first strip (A) has been arranged in the open or extraction configuration (E) by applying to the same a force (F) indicated by an arrow.

FIG. 2 shows a schematic view of the container of FIG. 1), wherein a first strip (A) has been arranged in the open or extraction configuration (E) by applying to the same a force (F) indicated by an arrow.

Figure 3:
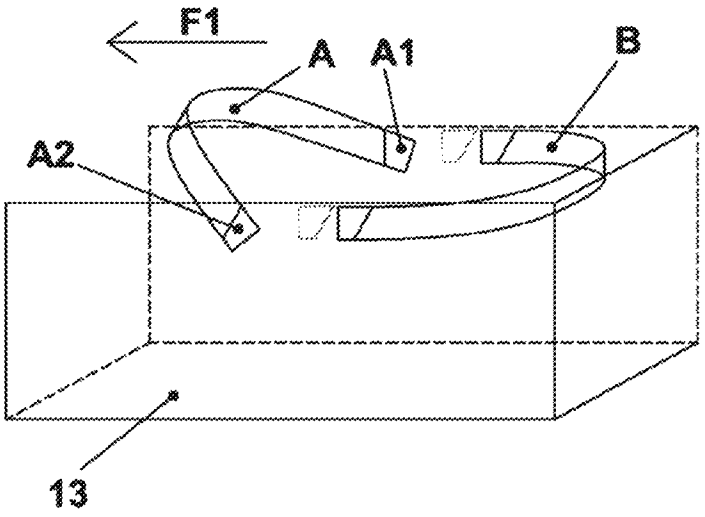
FIG. 3 is a schematic illustration showing how the ends (A1, A2) of said first strip (A) can be removed from the container (1) by applying a further force (FI) in the direction indicated by the arrow.

FIG. 3 schematically shows how the ends (A1, A2) of said first strip (A) can be removed from the container (1) by applying a further force (F1) in the direction indicated by the arrow.

Figure 4:
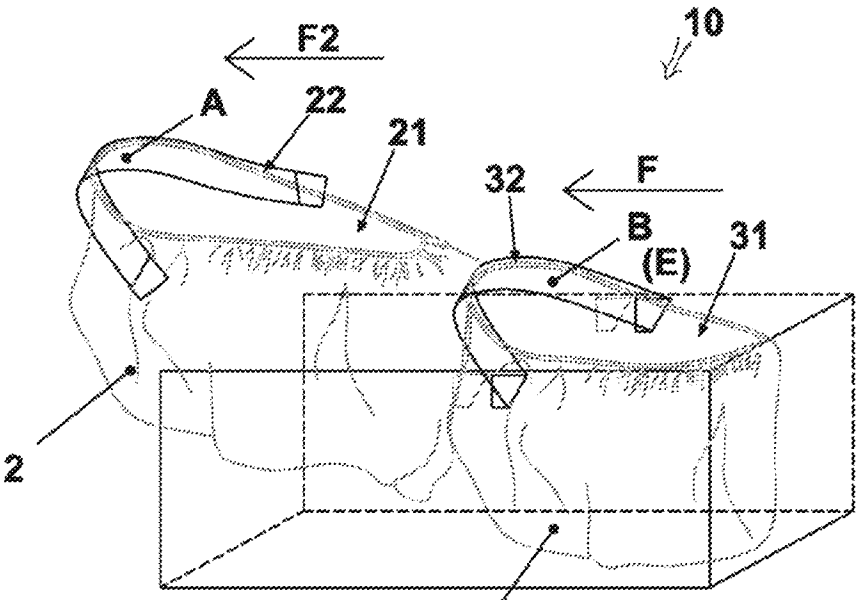
FIG. 4 is a schematic illustration showing how, by applying a further force (F2) in the direction indicated by the arrow, it is possible to fully unfold the first shoe cover (2), completely extending also the elastic band that is provided along the edge (22) of the opening (21), and thus extract said first shoe cover (2).

FIG. 4 schematically shows how, by applying a further force (F2) in the direction indicated by the arrow, it is possible to fully unfold the first shoe cover (2), completely extending also the elastic band that is provided along the edge (22) of the opening (21), and thus extract said first shoe cover (2).

Said first shoe cover (2), furthermore, is constrained to the strip (B) of the successive shoe cover (3), and thus the user, while unfolding said first shoe cover (2), also exerts a traction force on said second strip (B) of the successive shoe cover (3), so that also said second strip (B) is arranged in the open or extraction configuration (E).

Therefore, the force required to completely stretch the elastic band of said first shoe cover (2) and to deform the strip (B) of the successive shoe cover (3) is smaller than the force required to remove said first shoe cover (2) from said strip (B) of the successive shoe cover (3).

For the sake of graphic clarity, FIGS. 1, 2 and 3 do not show the shoe covers (2, 3) constrained to the respective strips (A, B), instead they are represented only in FIG. 4.

The shoe covers (2, 3) are coverings in the form of bags, provided with an opening (21, 31) for the insertion of a foot. Said strips (A, B) are arranged along or in proximity to the edge (22, 32) of said opening (21, 31), preferably outside the covering.

Figure 5:
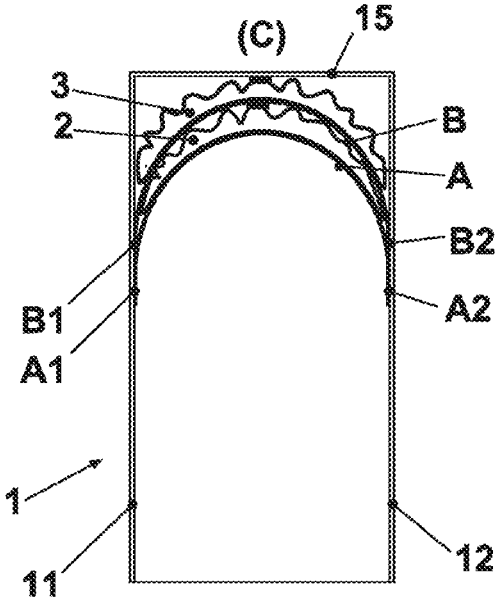
FIG. 5 is a top view of the container (1) of FIG. 1, in which there are two closed shoe covers (2, 3), each with its strip (A, B) in the closed configuration (C).

Said strips (A, B), more specifically, are arranged on the rear part of the shoe cover, meaning on the part that will be worn at the level of the rear part of the foot, above the heel. FIG. 5 shows a top view of the container (1) of FIG. 1, in which there are two closed shoe covers (2, 3), each with its strip (A, B) in the closed configuration (C).

Each strip (A, B) has both ends (A1, A2, B1, B2) constrained to the opposite sides (11, 12) of the container (1).

Figure 6:
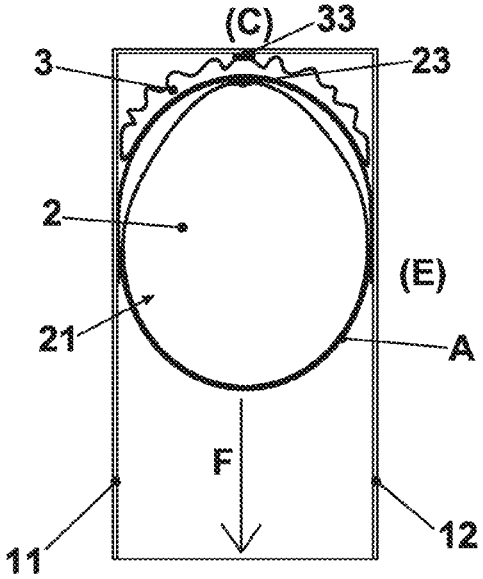
FIG. 6 is a schematic illustration showing how the first shoe cover (2) is opened by applying a traction force (F) to the first strip (A), which is brought to the extraction configuration (E), unfolding the shoe cover (2) and opening the foot insertion opening (21).

In FIG. 6, the first shoe cover (2) is opened by applying a traction force (F) to the first strip (A), which is brought to the extraction configuration (E), unfolding the shoe cover (2) and opening the foot insertion opening (21).

The first shoe cover (2) has at least one part (23) constrained to said second strip (B) of the second shoe cover (3) in a removable manner.

The last shoe cover (3) contained in the container (1) has at least one part (33) constrained in a removable manner to a head side (15) of the container (1).

Figure 7:
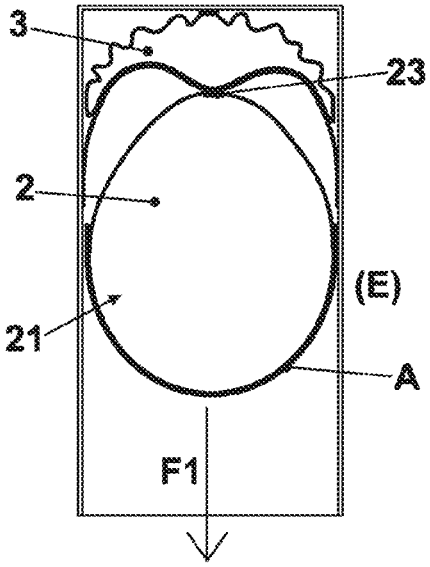
FIGS. 7-8 are schematic illustrations showing how the application of a further force (FI) to said first shoe cover (2) in the direction indicated by the arrow causes the strip (A) to become detached from the container (1).
Figure 8:
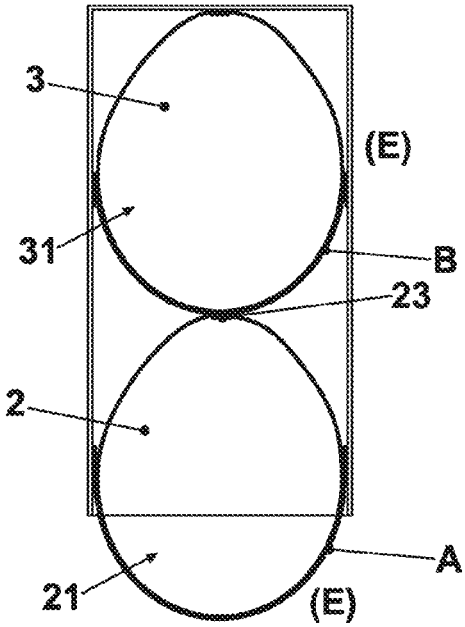

FIGS. 7 and 8 schematically show how the application of a further force (F1) to said first shoe cover (2) in the direction indicated by the arrow causes the strip (A) to become detached from the container (1).

Furthermore, said first shoe cover (2), constrained to the strip (B) of the second shoe cover (3), pulls said strip (B) and moves it from the closed configuration (C) to the extraction configuration (E).

The application of a further force causes said first shoe cover (2), which is fitted around the user's foot, to be detached from said second shoe cover (2, 3), which remains in the container (1) ready for use, that is, with open insertion opening (31).

Said ends (A1, A2, B1, B2) of said strips (A, B) are provided with a folding line (A3, B3) intended to facilitate/guide the change from said first closed configuration (C) to said second open/extraction configuration (E).

Said folding line (A3, B3) is inclined with respect to the direction of extension of said strip (A, B) by an angle which is larger than 0° and smaller than 90°, and preferably included between 45° and 60°.

More specifically, said folding line (A3, B3) is inclined in such a way that the strip (A, B) is bent upwards.

Said strip (A, B) is constrained to said container (1) in such a way that in said closed position (C) it is substantially horizontal, that is, parallel to the bottom (13) of said container (1), while in said open/extraction configuration (E) said strip (A, B), folded along said folding line (A3, B3), is inclined by an angle equal to twice said angle defined by the folding line.

By way of example, if the folding line (A3, B3) is inclined by 45°, in said extraction configuration (E) the strip (A, B) is orthogonal to the preceding closed configuration (C), and is facing upwards.

According to another example, if the folding line (A3, B3) is inclined by 60°, in said extraction configuration (E) the strip is inclined by a 120° angle with respect to the preceding closed configuration (C), and facing upwards.

These are the schematic outlines that are sufficient to the expert in the art to carry out the invention; consequently, on practical application variants can be developed which do not affect the substance of the innovative concept introduced herein.

Therefore, with reference to the above description and the attached drawings, the following claims are expressed.

What is claimed is:

1. Shoe cover dispenser (10) comprising a container (1) with two opposite containment sides (11, 12) and an opening designed for the insertion of a foot, and a plurality of shoe covers (2, 3) contained in said container (1), each shoe cover (2, 3) in turn comprising a covering provided with an opening (21, 31) for the insertion of a foot, characterized in that each one of said shoe covers (2, 3) comprises at least one flexible strip (A, B) constrained along or in proximity to a part of the edge (22, 32) of said opening (21, 31) of the covering, and wherein the length of said strip (A, B) exceeds the distance between said two opposite sides (11, 12) of said container (1), and wherein the ends (A1, A2, B1, B2) of said strip (A, B) are respectively constrained to said opposite sides (11, 12) in such a way that said strip is forcedly held between said sides (11, 12) while assuming the form of a U.

2. Shoe cover dispenser (10) according to claim 1, characterized in that said strip (A, B) is flexible, so that it can assume at least two configurations, meaning a first closed configuration (C), in which said strip (A, B) is arranged so as to form a U with its concave part facing in a first direction, and a second open or extraction configuration (E), in which said strip (A, B) is arranged so as to form a U with its concave part facing in the opposite direction with respect to said first closed configuration (C).

3. Shoe cover dispenser (10) according to claim 2, characterized in that said ends (A1, A2, B1, B2) of said strips (A, B) are provided with a folding line (A3, B3) intended to facilitate/guide the change from said first closed configuration (C) to said second open/extraction configuration (E).

4. Shoe cover dispenser (10) according to claim 3, characterized in that said folding line (A3, B3) is inclined by an angle larger than 0° and smaller than 90°, and preferably included between 45° and 60°, with respect to the direction of extension of said strip (A, B).

5. Shoe cover dispenser (10) according to claim 1, characterized in that it comprises a pack of shoe covers (2, 3), in which each shoe cover (2), except for the last shoe cover in the pack, comprises a part, positioned opposite the strip (A) of the same shoe cover (2), which is constrained in a removable manner to the strip (B) of the successive shoe cover (3).

6. Shoe cover dispenser (10) according to claim 5, characterized in that it comprises constraining means suited to constrain two successive shoe covers (2, 3), and wherein said constraining means are configured in such a way that the force applied to change the configuration of a strip (A, B) from said closed configuration (C) to said open configuration (E) is smaller than the force required to detach a shoe cover (2) from the strip (B) of the successive shoe cover (3).

7. Shoe cover dispenser (10) according to claim 1, characterized in that said ends (A1, A2, B1, B2) of said strips (A, B) are constrained to said sides (11, 12) of the container (1) through removable constraint means configured in such a way that the force required to change the configuration of a strip (A, B) from said closed configuration (C) to said open configuration (E) is smaller than the force required to detach the ends (A1, A2, B1, B2).

8. Shoe cover dispenser (10), according to claim 1, characterized in that each shoe cover (2,3) comprises an elastic band arranged along the edge (22, 32) of said opening (21, 31), and wherein said elastic band is configured in such a way that the force required to unfold it completely is smaller than the force required to cause said shoe cover (2) to become detached from the strip (B) of the successive shoe cover (3).

* * * * *